US006960876B2

(12) United States Patent
Kuo et al.

(10) Patent No.: US 6,960,876 B2
(45) Date of Patent: Nov. 1, 2005

(54) ELECTRON EMISSION DEVICES

(75) Inventors: Huei-Pei Kuo, Cupertino, CA (US); Si-Ty Lam, Pleasanton, CA (US); Sam Burriesci, Sunnyvale, CA (US); Steven Louis Naberhuis, Fremont, CA (US); Henryk Birecki, Palo Alto, CA (US); Xia Sheng, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 105 days.

(21) Appl. No.: 10/374,101

(22) Filed: Feb. 27, 2003

(65) Prior Publication Data

US 2004/0169457 A1 Sep. 2, 2004

(51) Int. Cl.[7] ..... H01J 1/62

(52) U.S. Cl. ..... 313/495; 313/309; 313/310; 313/336; 313/351

(58) Field of Search ..... 313/309, 310, 313/336, 351, 495, 414

(56) References Cited

U.S. PATENT DOCUMENTS 4,498,952 A * 2/1985 Christensen ..... 438/20
5,581,146 A * 12/1996 Pribat et al. ..... 313/309

FOREIGN PATENT DOCUMENTS

JP 09306338 A * 11/1997 ..... H01J 3/18

* cited by examiner

*Primary Examiner*—Vip Patel

(57) ABSTRACT

An electron emission device with nano-protrusions is described. Electrons are emitted from the nano-protrusions and directed by one or more conductors into beams. The beams may be shaped to be collimated, diverged, or converged. The shaped beams from one or more nano-protrusions may be focused onto a target spot through the use of additional electron optics.

21 Claims, 10 Drawing Sheets

ELECTRON EMISSION DEVICES

RELATED APPLICATIONS

The following application of the common assignee, incorporated by reference in its entirety, may contain some common disclosure and may relate to the present invention:

U.S. patent application Ser. No. 09/975,296, filed on Oct. 12, 2001 entitled "APPARATUS AND METHOD FOR FIELD-ENHANCED MIS/MIM ELECTRON EMITTERS".

FIELD OF THE INVENTION

This invention relates generally to electron emission devices. In particular, the invention relates generally to electron emission devices with self-aligned extraction and beam shaping capabilities and methods of fabrication and uses thereof.

BACKGROUND OF THE INVENTION

Electron emission technology exists in many forms today. For example, cathode ray tubes (CRT) are prevalent in many devices such as TVs and computer monitors. Electron emission plays a critical role in devices such as x-ray machines and electron microscopes. In addition, microscopic cold cathodes can be employed in electron-beam lithography used, for example, in making integrated circuits, in information storage devices such as those described in Gibson et al, U.S. Pat. No. 5,557,596, in microwave sources, in electron amplifiers, and in flat panel displays. Actual requirements for electron emission vary according to application. In general, electron beams need to deliver sufficient current, be as efficient as possible, operate at application-specific voltages, be focusable, be reliable at the required power densities, and be stable both spatially and temporally at a reasonable vacuum for any given application. Portable devices, for example, demand low power consumption.

Metal-Insulator-Semiconductor (MIS) and Metal-Insulator-Metal (MIM) electron emitter structures are described in Iwasaki et al, U.S. Pat. No. 6,066,922. In such structures with the application of a potential between the electron supply layer and the thin metal top electrode, electrons are 1) injected into the insulator layer from the electron supply layer (metal or semiconductor), 2) accelerated in the insulator layer, 3) injected into the thin metal top electrode, and 4) emitted from the surface of the thin metal top electrode. Depending upon the magnitude of the potential between the electron supply and thin metal top electrode layers, such emitted electrons can possess kinetic energy substantially higher than thermal energy at the surface of the thin metal film. Hence, these emitters may also be called ballistic electron emitters.

Shortcomings of MIS or MIM devices include relatively low emission current densities (typically about 1 to 10 $mA/cm^2$) and poor efficiencies (defined as the ratio of emitted current to shunt current between the electron supply layer and the thin metal electrode) (typically approximately 0.1%).

Electrons may also be emitted from conducting or semiconducting solids into a vacuum through an application of an electric field at the surface of the solid. This type of electron emitter is commonly referred to as a field emitter. Emitted electrons from field emitters possess no kinetic energy at the surface of the solid. The process for making tip-shaped electron field emitters, hereinafter referred to as Spindt emitters, is described in C. A. Spindt, et al, "Physical Properties of Thin-Film Field Emission Cathodes with Molybdenum Cones", Journal of Applied Physics, vol. 47, No. 12, Dec. 1976, pp. 5248–5263. For a Spindt emitter, the electron-emitting surface is shaped into a tip in order to induce a stronger electric field at the tip surface for a given potential between the tip surface and an anode; the sharper the tip, the lower the potential necessary to extract electrons from the emitter.

The shortcomings of Spindt emitters include requiring a relatively hard vacuum (pressure $<10^{-6}$ Torr, preferably $<10^{-8}$ Torr) to provide both spatial and temporal stability as well as reliability. Furthermore, the angle of electron emission is relatively wide with Spindt emitters making emitted electron beams relatively more difficult to focus to spot sizes required for electron-beam lithography or information storage applications. Operational bias voltages for simple Spindt tips are relatively high, ranging up to 1000 volts for a tip-to-anode spacing of 1 millimeter.

With previous design of electron emitters, aligning electron emitters has been difficult. Also, fabricating emitters that work at low operating voltage have been difficult as well.

SUMMARY OF THE INVENTION

According to an embodiment of the present invention, an electron emitting device comprises an electron supply structure; at least one nano-protrusion integrally formed on a top of the electron supply structure; an emitter insulator formed above the electron supply structure; and a top conductor formed above the emitter insulator such that the at least one nano-protrusion is exposed.

According to another embodiment of the present invention, an electron beam focusing device comprises a plurality of electron beam emitters and an electron beam focusing lens configured to focus electron beams emitted from the plurality of electron beam emitters.

According to yet another embodiment of the present invention, a method for forming electron emitting device comprises forming an electron supply structure; integrally forming at least one nano-protrusion on a top of the electron supply structure; forming an emitter insulator above the electron supply structure; forming a top conductor above the emitter insulator; and exposing the at least one nano-protrusion.

According to a further embodiment of the present invention, a method for forming an electron beam focusing device comprises forming a plurality of electron beam emitters and forming an electron beam focusing lens configured to focus electron beams emitted from the plurality of electron beam emitters.

BRIEF DESCRIPTION OF THE DRAWINGS

Features of the present invention will become apparent to those skilled in the art from the following description with reference to the drawings, in which:

FIGS. 8A-2 and 8D-2 illustrate exemplary modifications to the steps shown in FIGS. 8A–8D to form the electron emitter according to the fourth embodiment of the present invention.

DETAILED DESCRIPTION

For simplicity and illustrative purposes, the principles of the present invention are described by referring mainly to exemplary embodiments thereof. However, it is to be understood that the same principles are equally applicable to many types of electron emitters.

Figure 1A:
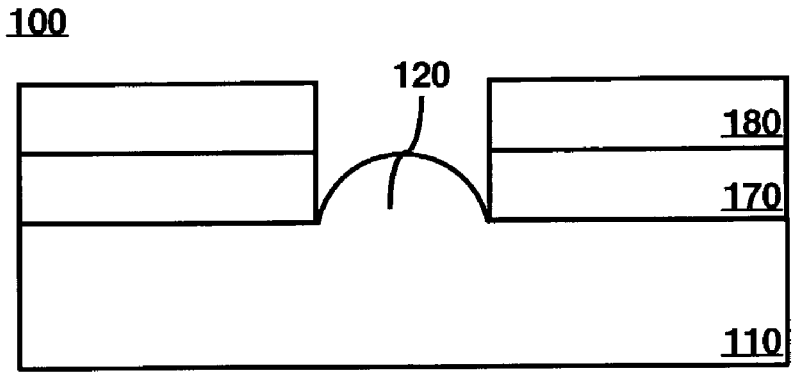
FIGS. 1A–1B illustrate electron emitters according to first and second embodiments of the present invention.

FIG. 1A illustrates an electron emitter 100 according to a first embodiment of the present invention. As shown, the emitter 100 may include a conductive substrate 110 with a nano-protrusion 120 formed integrally with the conductive substrate 110, i.e. the conductive substrate 110 and the nano-protrusion 120 are made from the same material. The emitter 100 may also include an emitter insulator 170 above the conductive substrate 110 and a top conductor 180 above the emitter insulator 170. The emitter insulator 170 and the top conductor 180 are formed such that the nano-protrusion 120 is exposed.

The conductive substrate 110 and the nano-protrusion 120 may be formed from any combination of metal, doped polysilicon, doped silicon, graphite, a metal coating on glass, a metal coating on ceramic, a metal coating on plastic, an ITO coating on glass, an ITO coating on ceramic, an ITO coating on plastic, and the like. Note that glass, ceramic, and plastic may be considered as an insulating substrate upon which the metal is coated. In an embodiment, the height of the nano-protrusion 120 substantially ranges from 5–50 nm.

The metal or metal coating may include any combination of aluminum, tungsten, titanium, copper, gold, tantalum, platinum, iridium, palladium, rhodium, chromium, magnesium, scandium, yttrium, vanadium, zirconium, niobium, molybdenum, silicon, beryllium, hafnium, silver, and osmium and alloys and multilayered films thereof.

The emitter insulator 170 may be formed from any combination of diamond-like carbon and oxides, nitrides, carbides, and oxynitrides of silicon, aluminum, titanium, tantalum, tungsten, hafnium, zirconium, vanadium, niobium, molybdenum, chromium, yttrium, scandium, nickel, cobalt, beryllium, polyimide, and magnesium. In an embodiment, the emitter insulator 170 substantially ranges in thickness from 5–1000 nm.

The top conductor 180 may be formed from any combination of a metal, conductive oxides, nitrides and carbides of metals, doped polysilicon, graphite, and alloys, and multilayered films thereof. Like the conductive substrate 110, the metal of the top conductor 180 may be any combination of aluminum, tungsten, titanium, molybdenum titanium, copper, gold, silver, tantalum, platinum, iridium, palladium, rhodium, chromium, magnesium, scandium, yttrium, vanadium, zirconium, niobium, molybdenum, hafnium, silver, and osmium and any alloys and multilayered films thereof. In an embodiment, the top conductor 180 substantially ranges in thickness from 5–1000 nm.

Figure 1B:
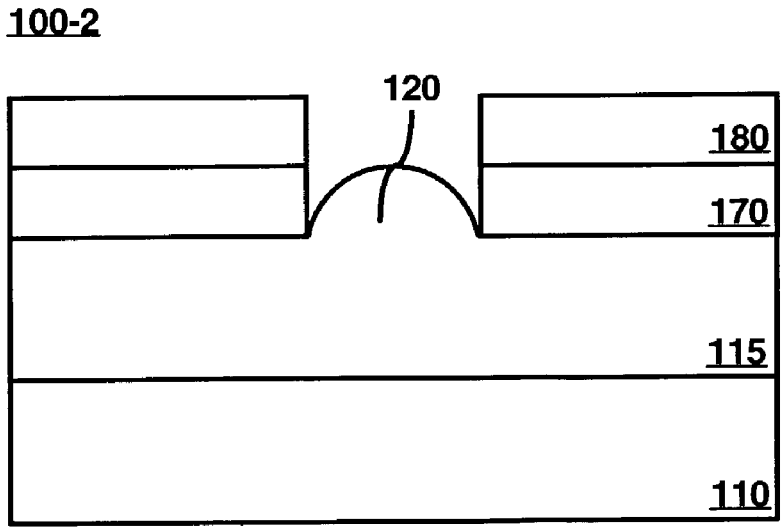

FIG. 1B illustrates an electron emitter 100-2 according to a second embodiment of the present invention. The electron emitter 100-2 is similar to the first embodiment 100 in that it includes a conductive substrate 110, a nano-protrusion 120, an emitter insulator 170, and a top conductor 180. The types of materials that may be used to form the conductive substrate 110, the emitter insulator 170, and top conductor 180 and exemplary dimensions thereof are similar to the emitter 100 and thus are not repeated here.

The emitter 100-2 of the second embodiment may include an electron supply layer 115 above the conductive substrate 110 and the nano-protrusion 120 may be integrally formed with the electron supply layer 115. The electron supply layer 115 and the nano-protrusion 120 may be formed from a doped or from an undoped semiconductor. The thickness of the electron supply layer may range substantially from 5–1000 nm and the nano-protrusion whose diameter may range substantially from 5 to 60 nm.

Note that a junction may be formed between the electron supply layer 115 and the conductive substrate 110. The characteristics of the junction may be tailored to be optimal for controlling beam current for applications such as E-beam lithography, displays, storage devices, and microwave sources. Also, as will be made clear below, the conductive substrate 110 of the emitter 100 and a combination of the conductive substrate 110 and the electron supply layer 115 of the emitter 100-2 may be referred to as the electron supply structure.

Figure 2:
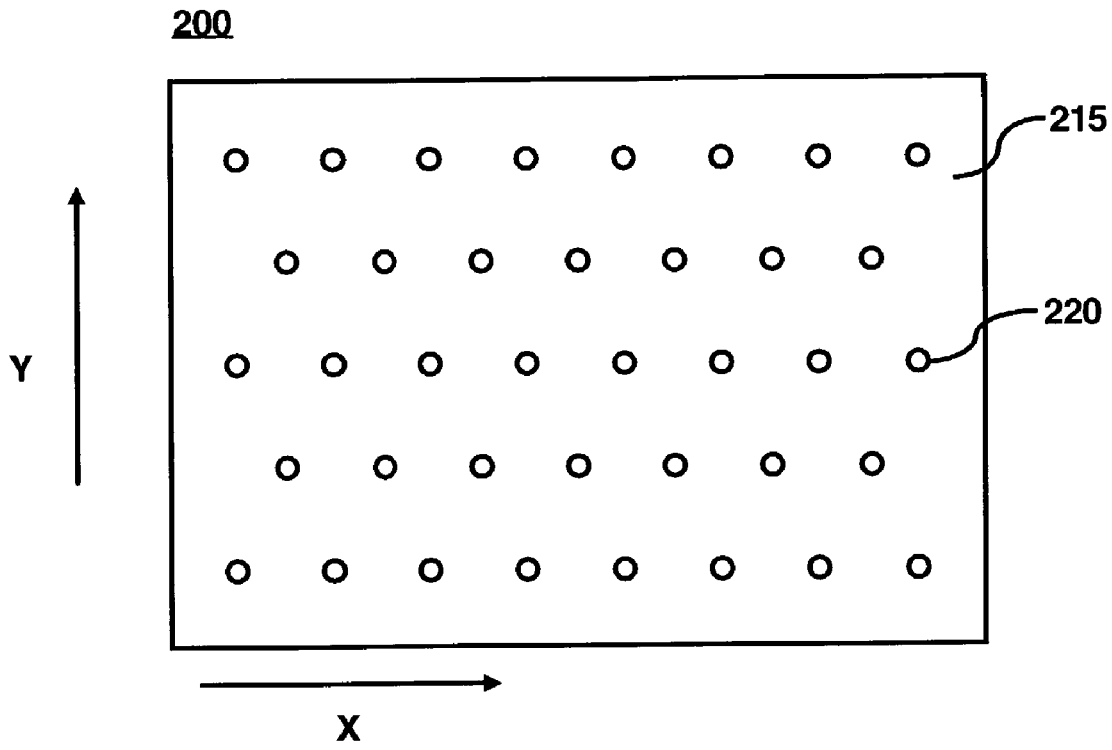
FIG. 2 illustrates a top view of an emitter with multiple nano-protrusions according to an embodiment of the present invention.

While FIGS. 1A and 1B illustrate examples of a single nano-protrusion structure, emitters may include multiple nano-protrusions. FIG. 2 illustrates a top view of an emitter 200, which includes multiple nano-protrusions 220 above an electron supply structure 215. The emitter insulator and the top conductor have been omitted for clarity. The density of the nano-protrusions 220 may substantially range from 20–200 per $\mu m^2$. However, the density range may differ from the range listed depending on the type of application envisioned.

The nano-protrusions 220 may be randomly spaced (not shown). Also, the nano-protrusions 220 may be substantially regularly spaced as shown in FIG. 2. In other words, if the nano-protrusions 220 are regularly spaced, the placements of the nano-protrusions 220 are such that the horizontal and vertical spacings between the nano-protrusions are substantially the same within some predefined tolerance. Also, the periodicity in the x and y directions may be different. In addition, the periodicity may be in any angle and not just in the x and y directions.

Figure 3A:
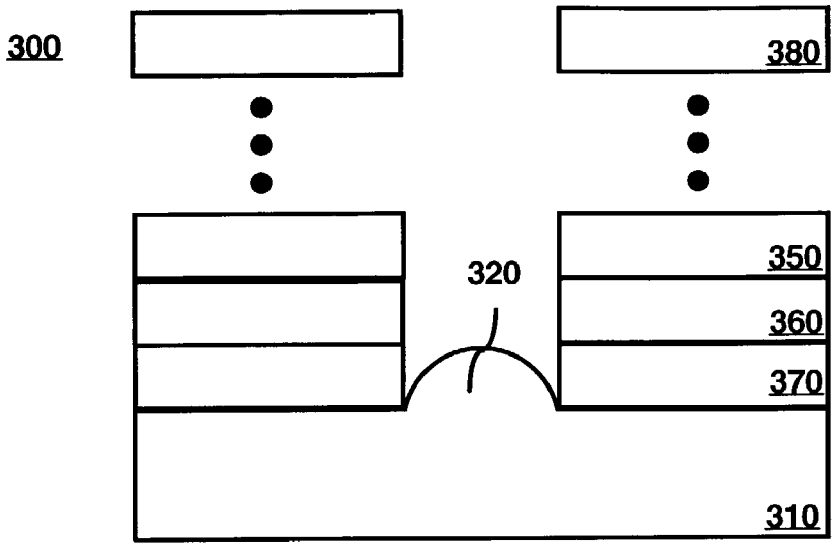
FIGS. 3A–3B illustrate electron emitters according to third and fourth embodiments of the present invention.

FIG. 3A illustrates an electron emitter 300 according to a third embodiment of the present invention. As shown, the emitter 300 may include a conductive substrate 310 with a nano-protrusion 320 above the conductive substrate 310. The nano-protrusion 320 may be formed integrally with the conductive substrate 310. The emitter 300 may also include an emitter insulator 370 and a top conductor 380 above the emitter insulator 370. In between the emitter insulator 370 and the top conductor 380, there may be one or more pairs of intervening conductors 360 and insulators 350, wherein the conductors 360 and the insulators 350 alternate. Again, the nano-protrusion 320 is exposed. The top conductor 380 may also be called a nano-lens 380.

The types of materials that may be used to form the conductive substrate 310, nano-protrusion 320, insulators 350 and 370, and conductors 360 and 380 and exemplary dimensions thereof are similar to the emitters 100 and 100-2 discussed above and thus are not repeated here.

Figure 4A:
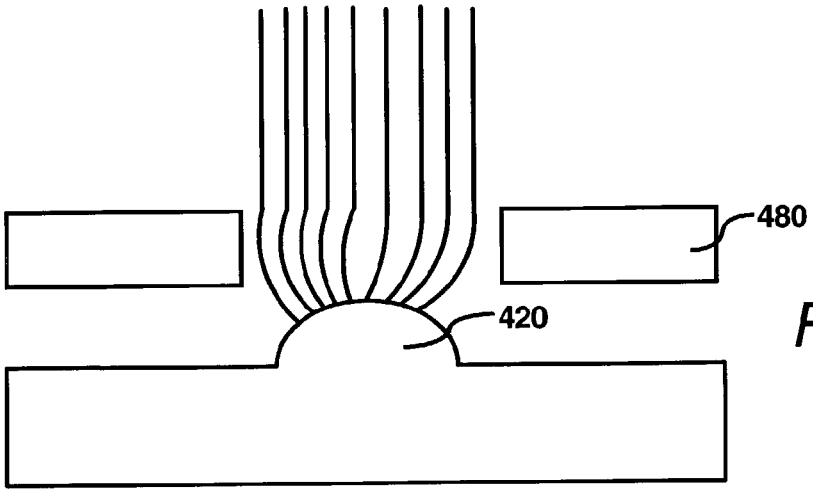
FIGS. 4A–4C illustrate example shaping effects of nano-lens on the emitted electron beam.
Figure 4B:
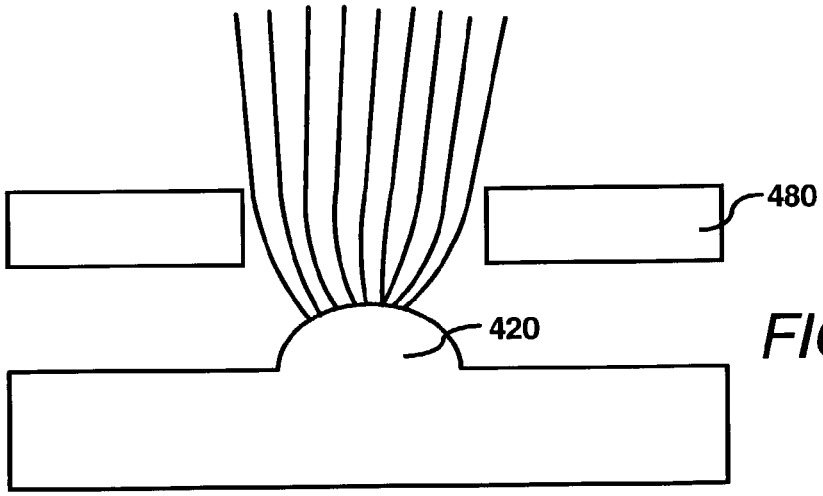
Figure 4C:
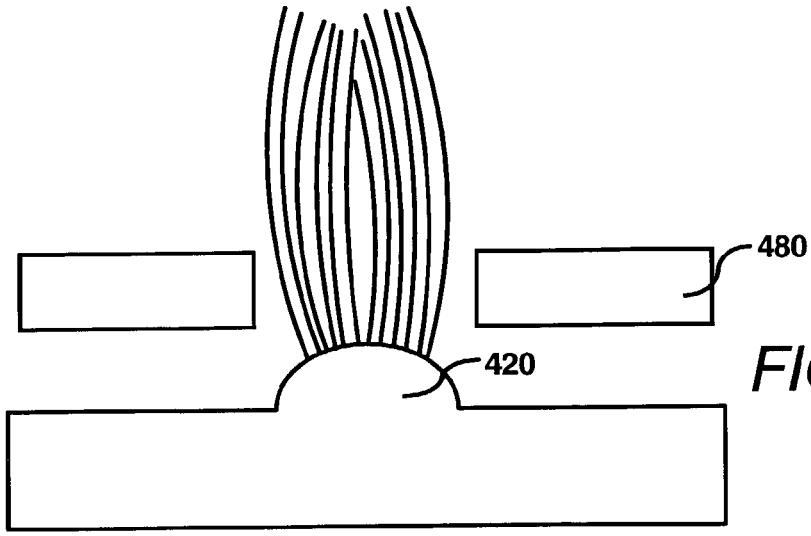

Any combination of the nano-lens 380 and the intervening conductors 360 may be used to shape the beam of electrons emitted from the nano-protrusion 320. FIGS. 4A–4C illustrate various shaping effects of nano-lens on the emitted electron beam. (In these figures, the emitter insulator and the intervening insulators and conductors have been omitted for clarity.) For example, in FIG. 4A, the emitted beam of electrons from the nano-protrusion 420 is collimated by the nano-lens 480 and intervening conductors (not shown). In FIG. 4B, the electron beam is shaped to be divergent, and in FIG. 4C, the beam is shaped to be convergent.

Figure 3B:
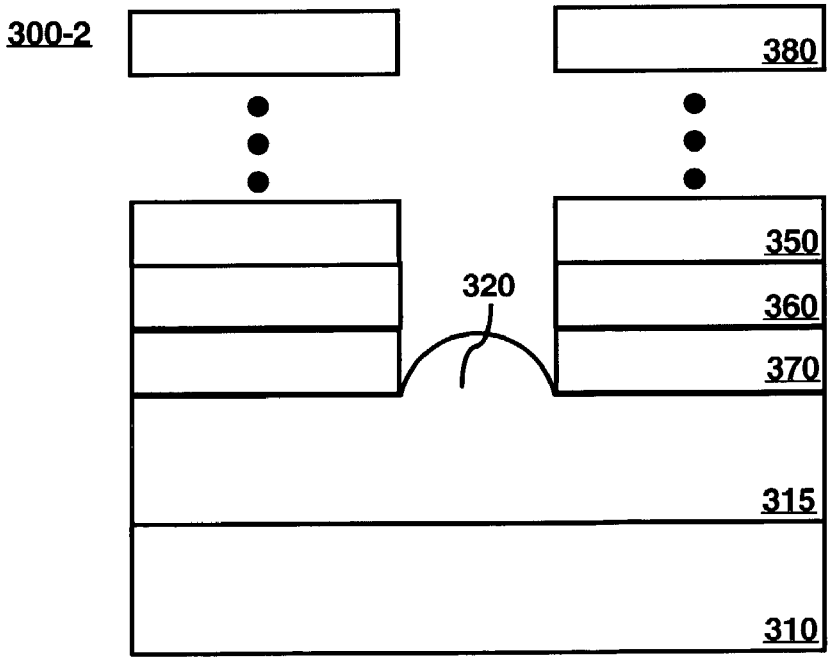

FIG. 3B illustrates an electron emitter 300-2 according to a fourth embodiment of the present invention. The electron emitter 300-2 is similar to emitter 300 in that it may include a conductive substrate 310, a nano-protrusion 320, an emitter insulator 370, one or more pairs of intervening conductors 360 and insulators 350, and a nano-lens 380.

Like the emitter 100-2, the emitter 300-2 includes an electron supply layer 315 above the conductive substrate 310 and the nano-protrusion 320 may be integrally formed with the electron supply layer 315. The electron supply layer 315 and the nano-protrusion 320 may be formed from a doped or from an undoped semiconductor, which as discussed above, may be tailored to provide an optimal junction between the electron supply layer 315 and the conductive substrate 310 or a series resistor between the conductive substrate 310 and the electron emission surface. Also as discussed above, any combination of the nano-lens 380 and the conductors 360 of the emitter 300-2 may be used to shape the emitted beam of electrons.

Again, the types of materials used to form the elements of the electrons emitters and exemplary dimensions thereof have been discussed and thus are not repeated.

Also, like the situation depicted in FIG. 2, an emitter structure may be formed that includes multiple nano-protrusions of type illustrated in FIGS. 3A–3B may be used. Also, the nano-protrusions may be randomly spaced or regularly spaced.

The beams emitted from one or more electron emitters may be focused to a particular target spot. For example, in order to prevent crosstalk between pixels, field emission displays employ appropriate electron optics to focus the beams from a plurality of electron emitters to a single pixel. Each display pixel is thereby illuminated solely with electrons from a corresponding multitude of emitters.

Figure 5:
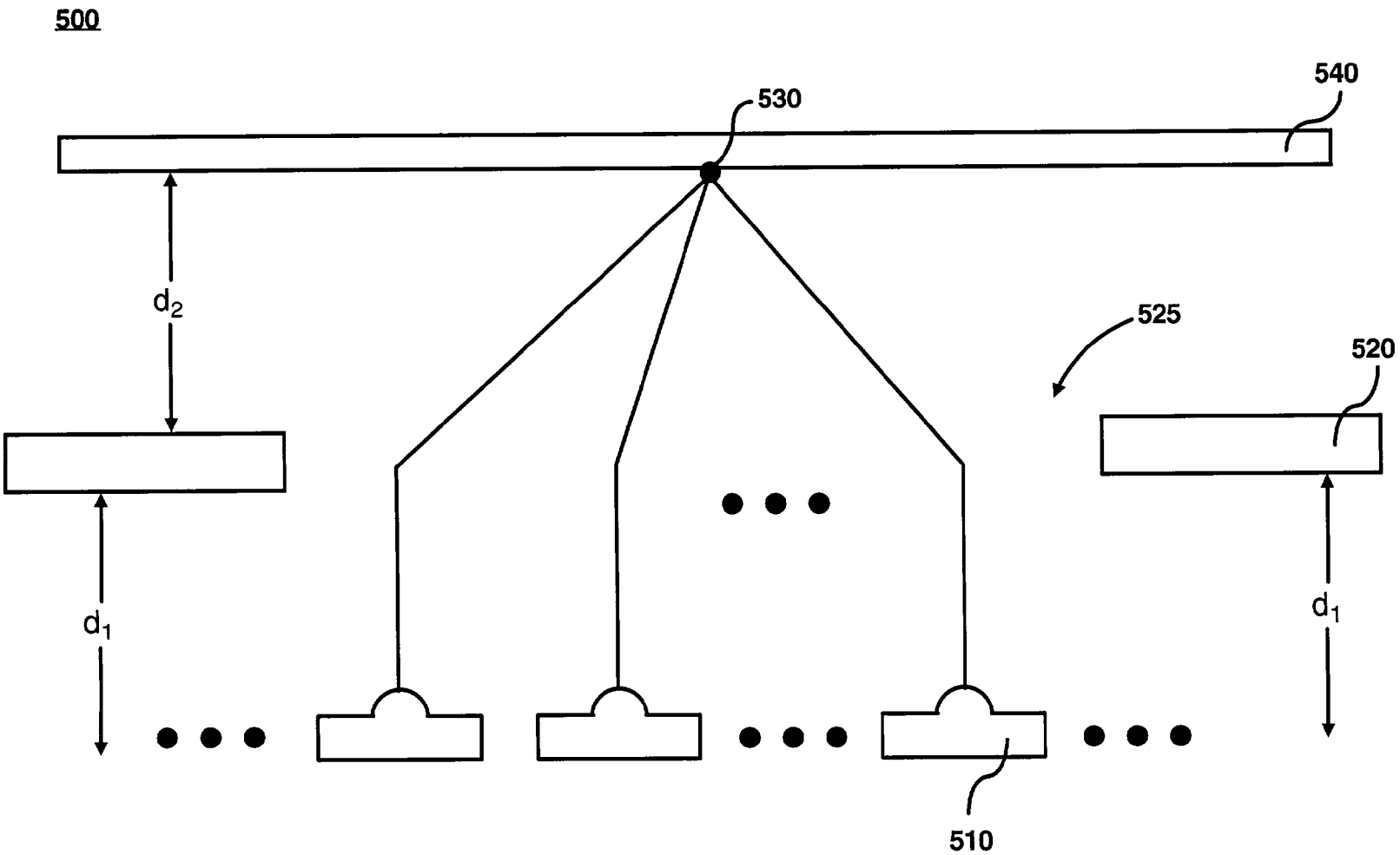
FIG. 5 illustrates an electron beam focusing device according to an embodiment of the present invention.

FIG. 5 illustrates an electron beam focusing device 500 according to an embodiment of the present invention. As shown, the focusing device 500 may include a plurality of electron beam emitters 510. The beam emitters 510 may be any combination of the emitters 100, 100-2, 300, and 300-2 as discussed above or other types of emitters. The focusing device 500 may also include an electron focusing lens 520 configured to focus the electron beams emitted from the plurality of electron beam emitters 510 on to a target spot 530 of a medium 540.

The focusing lens 520 may be formed from any combination of metal, conductive oxides, nitrides, carbides and oxynitrides of a metal and metal alloys, doped silicon, doped amorphous silicon, doped polysilicon, graphite, and alloys, and multilayered films thereof. The types of metal may include any combination of aluminum, tungsten, titanium, molybdenum titanium, copper, gold, silver, tantalum, platinum, iridium, palladium, rhodium, chromium, magnesium, scandium, yttrium, vanadium, zirconium, niobium, molybdenum, hafnium, silver, and osmium and any alloys and multilayered films thereof.

In an embodiment, the focusing lens 520 substantially ranges in thickness from 100–2000 nm. Also the diameter of an aperture 525 of the focusing lens 520 may range substantially from 0.1 to 300 $\mu$m depending on application. Additionally, a vertical distance $d_1$ from the emitters 510 and the focusing lens 520 and a vertical distance $d_2$ from the focusing lens to the target medium 540 may range substantially between 0.1 to 300 $\mu$m and 0.1 to 5000 $\mu$m respectively depending on application. In addition, the beam emitters 510 may be randomly or substantially regularly spaced.

Figure 6A:
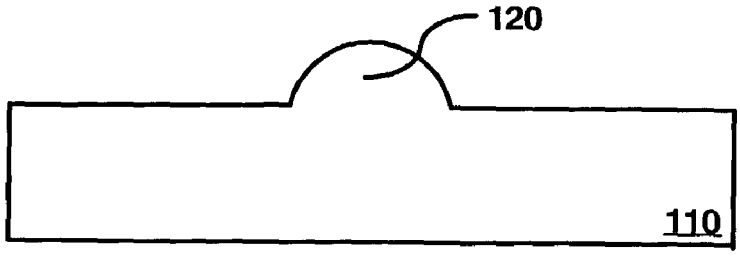
FIGS. 6A–6C illustrate an exemplary method to form the electron emitter according to the first embodiment of the present invention shown in FIG. 1A.
Figure 6B:
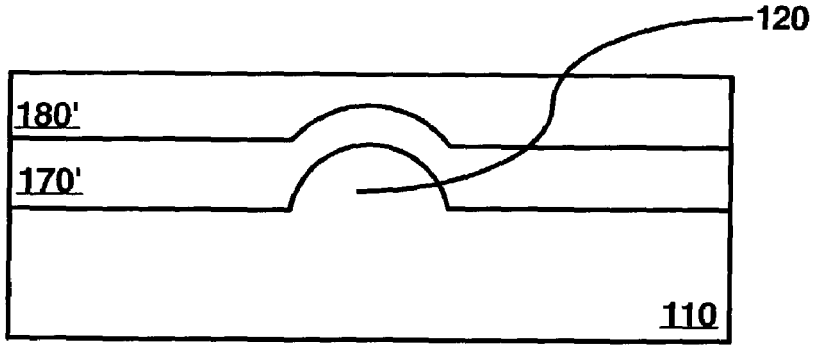
Figure 6C:
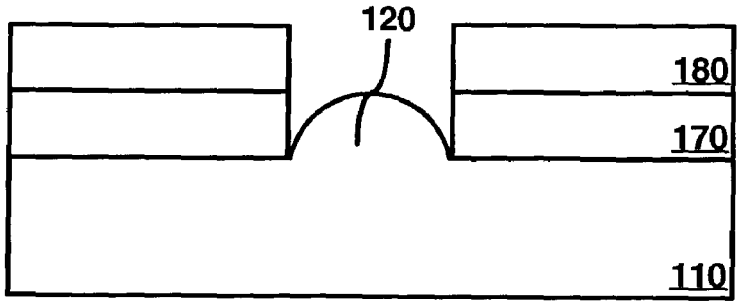

FIGS. 6A–6C illustrate an exemplary method to form the electron emitter 100 according to the first embodiment of the present invention shown in FIG. 1A. As shown in FIG. 6A, the conductive substrate 110 and the nano-protrusion 120 are formed, for example, by low pressure chemical vapor deposition (LPCVD) of doped polysilicon. The deposition process creates the nano-protrusions 120 integrally with the conductive substrate 110. Note that many other materials and processes may be used to form the conductive substrate 110 and the nano-protrusion 120.

Then as shown in FIG. 6B, an emitter insulator layer 170' and a top conductor layer 180' may be formed. For example, to form the emitter insulator layer 170', an oxide layer may be grown by thermal oxidation. Other means of forming the emitter insulator layer 170' may include physical vapor deposition (PVD) and/or chemical vapor deposition (CVD). Note that the emitter insulator layer 170' may be conformal to the nano-protrusion 120. To form the top conductor layer 180', conductive materials may be deposited, for example, by a PVD process. The top conductor layer 180' may be planarized.

Then as shown in FIG. 6C, the emitter insulator layer 170' and the top conductor layer 180' may be may be etched to form the emitter insulator 170 and the conductor 180 as well as to expose nano-protrusion 120. For example, the conductor 140 may be formed by ion etching the top conductor layer 180' above the nano-protrusion 120. Then the nano-protrusion 120 may be exposed by reactive ion etching or wet etching the emitter insulator layer 170', which also forms the emitter insulator 170. Other etching processes may be utilized to expose the nano-protrusion 120.

Figure 7A:
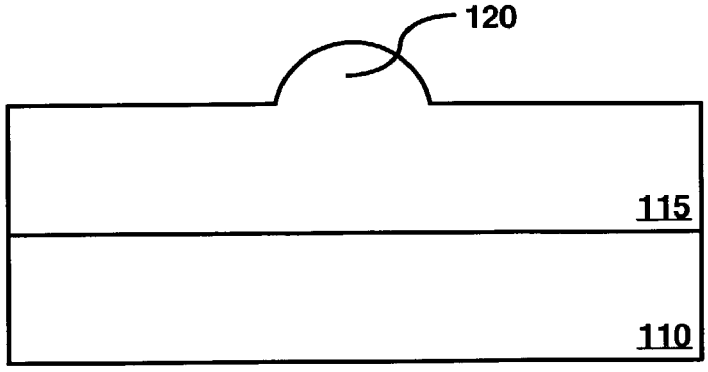
FIGS. 7A–7C illustrate an exemplary method to form the electron emitter according to the second embodiment of the present invention shown in FIG. 1B.
Figure 7B:
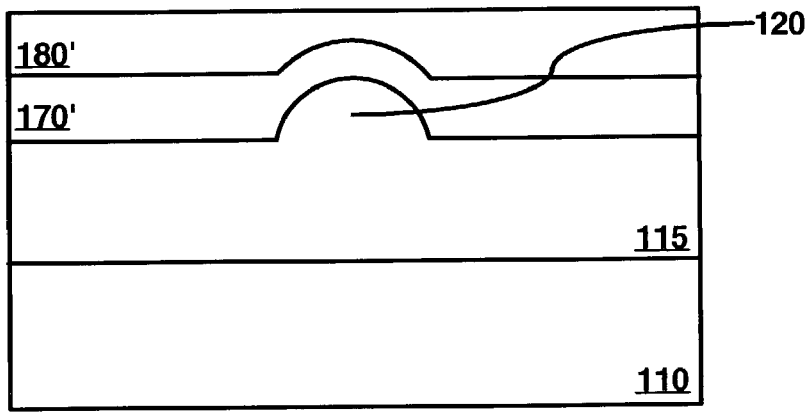
Figure 7C:
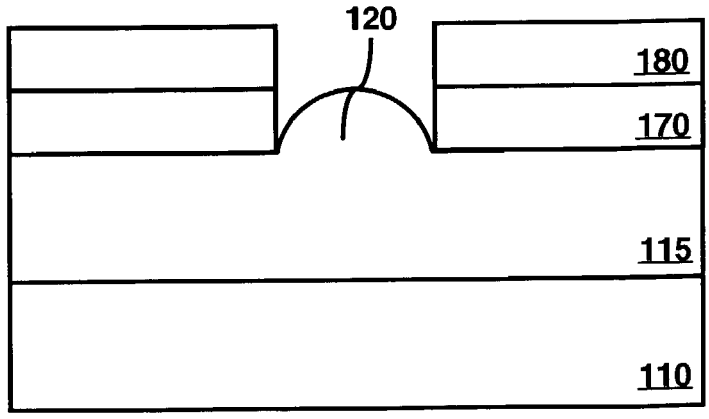

FIGS. 7A–7C illustrate an exemplary method to form the electron emitter 100-2 according to the second embodiment of the present invention shown in FIG. 1B. The steps are similar to the method illustrated in FIGS. 6A–6C, except an electron supply layer 115 is formed above the conductive substrate 110 and nano-protrusion 120 may be formed above the electron supply layer 115 and may be formed integrally with the electron supply layer 115.

Figure 8A:
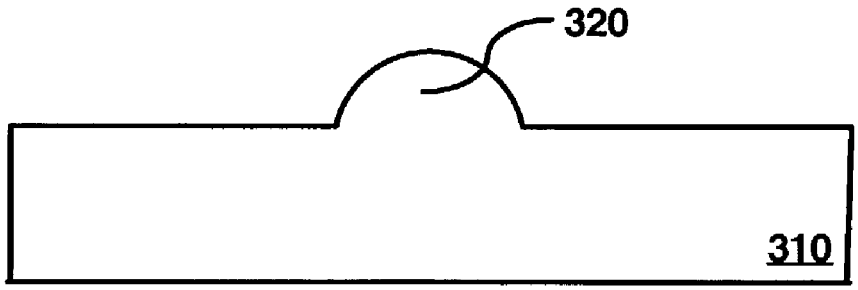
FIGS. 8A–8D illustrate an exemplary method to form the electron emitter according to the third embodiment of the present invention shown in FIG. 3A.

FIGS. 8A–8E illustrate an exemplary method to form the electron emitter 300 according to the third embodiment of the present invention shown in FIG. 3A. As shown in FIG. 8A, the conductive substrate 310 and the nano-protrusion 320 may be formed, for example, by low pressure chemical vapor deposition of metal or polysilicon. The deposition process creates the nano-protrusions 320 integrally with the conductive substrate 310. Note that many other materials and processes may be used to form the conductive substrate 310 and the nano-protrusion 320.

Figure 8B:
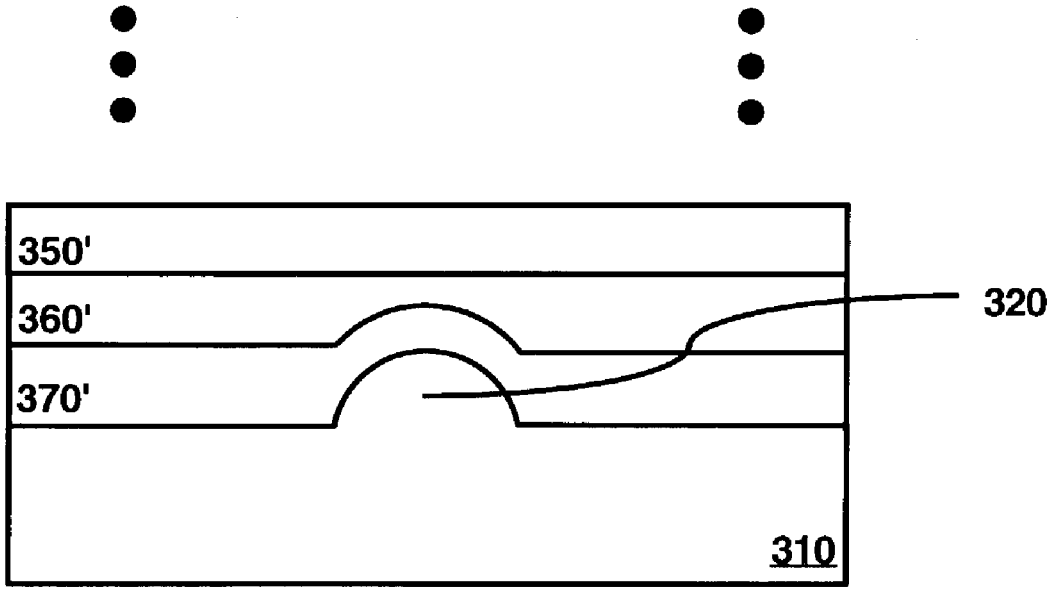

Then as shown in FIG. 8B, an emitter insulator layer 370' and one or more intervening conductor layers 360' and insulator layers 350' may be formed. For example, to form the emitter insulator layer 370', an oxide layer may be grown by thermal oxidation. Other means of forming the emitter insulator layer 370' may include PVD and/or CVD. Note that the emitter insulator layer 370' may be conformal to the nano-protrusion 120. The intervening conductor layers 360' may be formed, for example, by a PVD process. The insulator layers 350' may be formed, for example, by PVD or CVD. Both the intervening insulating and conductor layers 350' and 360' may be planarized.

Figure 8C:
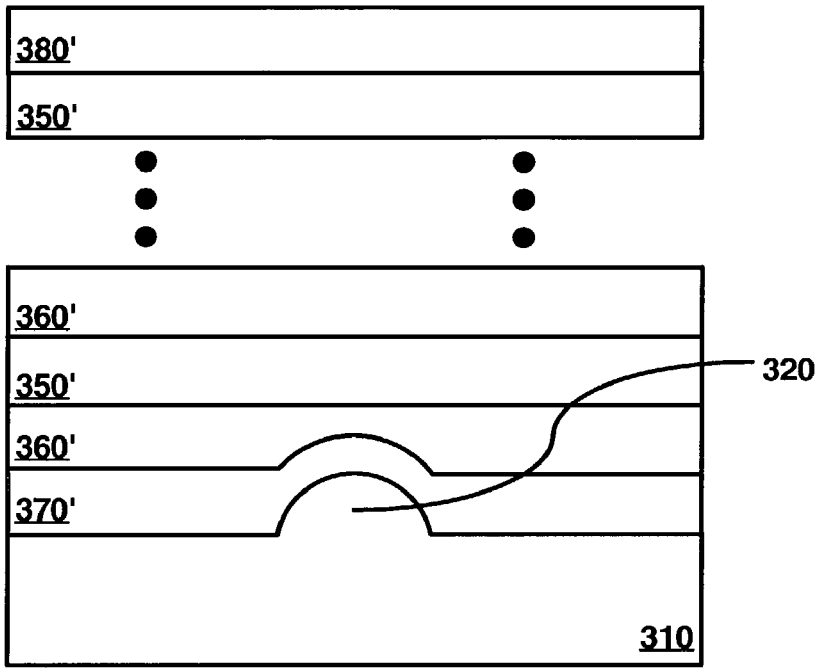

Then as shown in FIG. 8C, the nano-lens layer 380' may be formed by using the process similar to form the intervening conductor layer 360'. Again, the nano-lens layer 380' may be planarized.

Figure 8D:
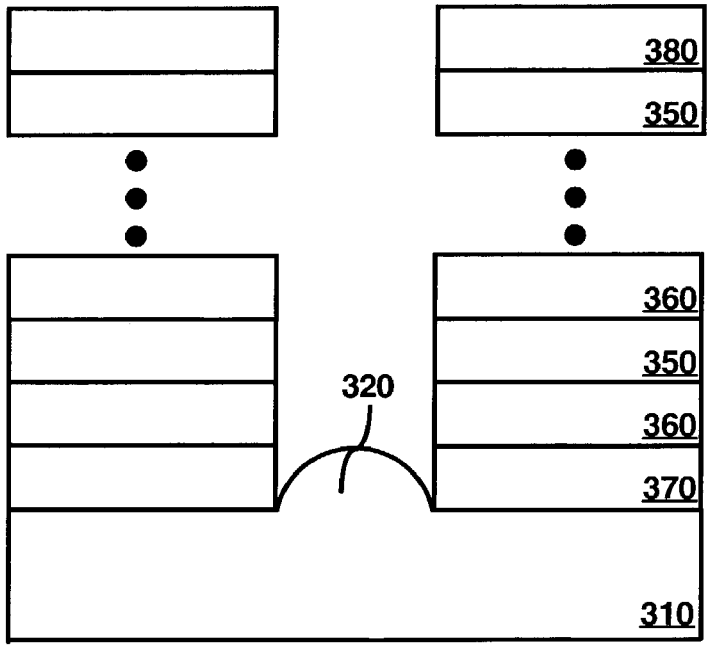
Figures 2, 8A:
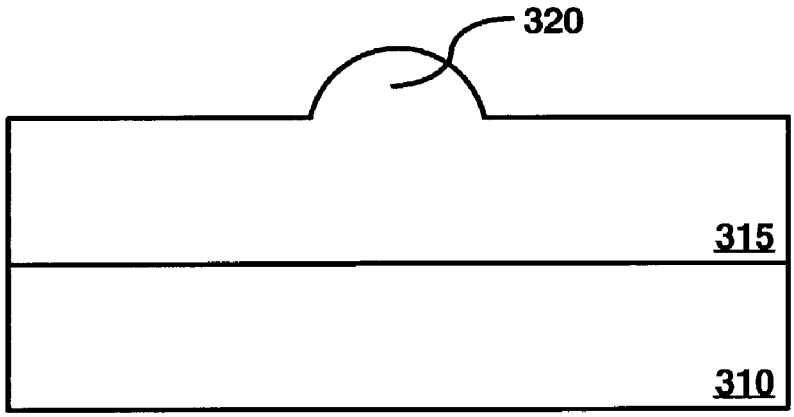
Figures 2, 8D:
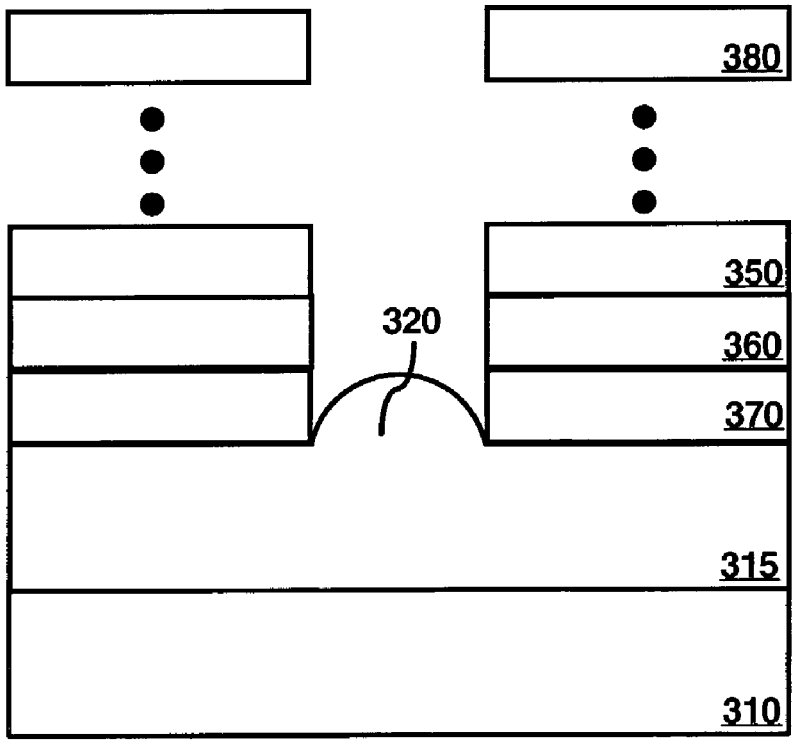

Then as shown in FIG. 8D, etching may take place to form intervening insulator(s) 350, intervening conductor(s) 360, emitter insulator 370, and the nano-lens 380 such that the nano-protrusion 320 is exposed. For example, the nano-lens 380 may be formed by ion beam etching the nano-lens layer 380' above the nano-protrusion 320. Also the emitter insulator layer 370', the intervening conductor layers 360', and the intervening insulator layers 350' may be wet etched or reactive ion etched.

FIGS. 8A-2 and 8D-2 illustrate an exemplary modification to the steps shown in FIGS. 8A–8D to form the electron emitter 300-2 according to the fourth embodiment of the present invention shown in FIGS. 3B. As shown in FIG. 8A-2, the step illustrated in FIG. 8A may be modified in that the electron supply layer 315 is formed above the conductive substrate 310 and the nano-protrusion 320 is formed above the electron supply layer 315. The remaining steps may be similar to the steps shown in FIGS. 8B–8E to arrive at the result shown in FIG. 8D-2.

While the invention has been described with reference to the exemplary embodiments thereof, it is to be understood that various modifications may be made to the described embodiments of the invention without departing from the spirit and scope of the invention. The terms and descriptions used herein are set forth by way of illustration only and are not meant as limitations. In particular, although the methods of the present invention has been described by examples, the steps of the method may be performed in a different order than illustrated or may be performed simultaneously. These and other variations are possible within the spirit and scope of the invention as defined in the following claims and their equivalents.

What is claimed is:

1. An electron emitting device, comprising:

an electron supply structure;

at least one nano-protrusion integrally formed on a top of the electron supply structure;

an emitter insulator formed above the electron supply structure; and a top conductor formed above the emitter insulator such that the at least one nano-protrusion is exposed.

2. The device of claim 1, wherein:

a height of the at least one nano-protrusion substantially ranges from 5–50 nm;

a diameter of the at least one nano-protrusion substantially ranges from 5–60 nm;

a thickness of the emitter insulator substantially ranges from 5–1000 nm; and a thickness of the top conductor substantially ranges from 5–1000 nm.

3. The device of claim 1, wherein the electron supply structure includes a conductive substrate.

4. The device of claim 3, wherein the conductive substrate is formed from at least one of a metal and a doped semiconductor.

5. The device of claim 4, wherein the metal or the doped semiconductor is coated on an insulating substrate.

6. The device of claim 5, wherein the insulating substrate includes at least one of glass, ceramic, and plastic.

7. The device of claim 4, wherein the metal includes at least one of aluminum, tungsten, titanium, copper, gold, tantalum, platinum, iridium, palladium, rhodium, chromium, magnesium, scandium, yttrium, vanadium, zirconium, niobium, molybdenum, silicon, beryllium, hafnium, silver, and osmium and alloys and multilayered films thereof.

8. The device of claim 4, wherein the doped semiconductor includes at least one of silicon, polysilicon, amorphous silicon and ITO.

9. The device of claim 3, wherein the electron supply structure further comprises an electron supply layer formed above the conductive substrate, wherein the at least one nano-protrusion is formed integrally with the electron supply layer.

10. The device of claim 9, wherein the electron supply layer is formed from at least one of a doped and an undoped semiconductor.

11. The device of claim 9, wherein a thickness of the electron supply layer electron supply layer substantially ranges from 5–1000 nm.

12. The device of claim 9, further including at least one pair of intervening conductor and intervening insulator placed between the emitter insulator and the top conductor.

13. The device of claim 12, wherein:

a thickness of the intervening insulator substantially ranges from 5–1000 nm; and a thickness of the intervening conductor substantially ranges from 5–1000 nm.

14. The device of claim 1, further including at least one pair of intervening conductor and intervening insulator placed between the emitter insulator and the top conductor.

15. The device of claim 14, wherein:

a thickness of the intervening insulator substantially ranges from 5–1000 nm; and a thickness of the intervening conductor substantially ranges from 5–1000 nm.

16. The device of claim 14, wherein each of the emitter insulator and the intervening insulator is formed from at least one of diamond-like carbon, plastic, and insulating oxides, nitrides, carbides, and oxynitrides of silicon, aluminum, titanium, tantalum, tungsten, hafnium, zirconium, vanadium, niobium, molybdenum, chromium, yttrium, scandium, nickel, cobalt, beryllium, magnesium and alloys and multilayered films thereof.

17. The device of claim 14, wherein each of the top conductor and the intervening conductor is formed from at least one of a metal, conductive oxides, nitrides, carbides and oxynitrides of metals and metal alloys, doped polysilicon, doped silicon, doped amorphous silicon, graphite, and alloys, and multilayered films thereof.

18. The device of claim 17, wherein the metal includes at least one of aluminum, tungsten, titanium, molybdenum titanium, copper, gold, silver, tantalum, platinum, iridium, palladium, rhodium, chromium, magnesium, scandium, yttrium, vanadium, zirconium, niobium, molybdenum, hafnium, silver, and osmium and any alloys and multilayered films thereof.

19. The device of claim 1, wherein a plurality of nano-protrusions are formed on the top of the electron supply structure.

20. The device of claim 19, wherein a density of the plurality of nano-protrusions substantially ranges from 20–200 per $\mu m^2$.

21. The device of claim 19, wherein the plurality of nano-protrusions are substantially regularly spaced.

* * * * *